US009291111B2

(12) United States Patent
Kawasumi

(10) Patent No.: US 9,291,111 B2
(45) Date of Patent: Mar. 22, 2016

(54) ENGINE CONTROL UNIT, ENGINE CONTROL SYSTEM AND ENGINE CONTROL METHOD

(75) Inventor: Shinji Kawasumi, Saitama-ken (JP)

(73) Assignee: Shindengen Electric Manufacturing Co., Ltd., Tokyo (JP)

( * ) Notice: Subject to any disclaimer, the term of this patent is extended or adjusted under 35 U.S.C. 154(b) by 346 days.

(21) Appl. No.: 13/823,737

(22) PCT Filed: Sep. 14, 2011

(86) PCT No.: PCT/JP2011/070939

§ 371 (c)(1),
(2), (4) Date: Mar. 15, 2013

(87) PCT Pub. No.: WO2012/036184

PCT Pub. Date: Mar. 22, 2012

(65) Prior Publication Data

US 2013/0180501 A1 Jul. 18, 2013

(51) Int. Cl.
*F02D 28/00* (2006.01)
*F02D 41/04* (2006.01)
(Continued)

(52) U.S. Cl.
CPC ..... *F02D 28/00* (2013.01); *F02D 41/042* (2013.01); *F02D 41/065* (2013.01); *F02N 11/08* (2013.01);
(Continued)

(58) Field of Classification Search
CPC ..... F02D 28/00; F02D 41/042; F02D 41/065; F02N 19/005; F02N 11/08
USPC ..... 701/101, 113; 123/349, 182.1; 73/114.05
See application file for complete search history.

(56) References Cited

U.S. PATENT DOCUMENTS 4,593,667 A * 6/1986 Sasaki et al. ..... 123/488
4,979,477 A * 12/1990 Nickel et al. ..... 123/335
(Continued)

FOREIGN PATENT DOCUMENTS

JP H03-3969 1/1991
JP H07-71350 3/1995
(Continued)

OTHER PUBLICATIONS

ISR for related PCT/JP2011/070939 mailed on Dec. 20, 2011 and its English translation.
(Continued)

*Primary Examiner* — Stephen K Cronin
*Assistant Examiner* — Susan E Scharpf
(74) *Attorney, Agent, or Firm* — Ladas & Parry, LLP

(57) ABSTRACT

An engine control method includes: a step of determining whether or not a crank angle of the engine lies in a first section between a top dead center in a compression stroke and a first angle in a case where the engine speed of the engine is lower than the prescribed engine speed; a step of running the engine in a forward direction by driving a motor that applies a torque to a crank of the engine in the forward direction in a case where the crank angle of the engine does not lie in the first section; a step of determining whether or not the crank angle of the engine lies in the first section; a step of determining whether or not the crank angle of the engine lies in a second section between a top dead center in a combustion stroke and a second angle; a step of braking the motor in a case where it is determined in the sixth step that the crank angle of the engine lies in the second section; and a step of running the engine in the forward direction by driving the motor in the forward direction in a case where it is determined in the eighth step that there is the request for restart of the engine.

15 Claims, 5 Drawing Sheets

(51) Int. Cl.

| | |
|---|---|
| ***F02D 41/06*** | (2006.01) |
| ***F02N 11/08*** | (2006.01) |
| ***F02N 19/00*** | (2010.01) |
| *F02D 41/00* | (2006.01) |

(52) U.S. Cl.

CPC ..... *F02N 19/005* (2013.01); *F02D 2041/0095* (2013.01); *F02N 2200/021* (2013.01); *F02N 2200/022* (2013.01); *F02N 2200/042* (2013.01)

(56) References Cited

U.S. PATENT DOCUMENTS

| | | | | |
|---|---|---|---|---|
| 4,987,888 | A | 1/1991 | Funabashi | |
| 5,226,390 | A * | 7/1993 | Nakagawa | 123/436 |
| 5,611,311 | A * | 3/1997 | Tomisawa | 123/406.47 |
| 6,382,188 | B2 * | 5/2002 | Hasegawa | F02L 1/3442 123/179.16 |
| 7,191,746 | B2 * | 3/2007 | Nakamura | 123/179.3 |
| 7,380,444 | B2 * | 6/2008 | Tokugawa et al. | 73/114.04 |
| 7,410,445 | B2 * | 8/2008 | Surewaard | F02B 75/06 192/42 |
| 7,673,608 | B2 | 3/2010 | Lewis | |
| 7,703,424 | B2 * | 4/2010 | Nakamura | F01L 1/3442 123/346 |
| 7,848,873 | B2 | 12/2010 | Fuwa | |
| 8,095,298 | B2 * | 1/2012 | Nakamura | F01L 1/3442 123/179.4 |
| 2004/0133333 | A1 * | 7/2004 | Surewaard | F02D 41/042 701/99 |
| 2007/0204827 | A1 | 9/2007 | Kishibata | |
| 2008/0162007 | A1 | 7/2008 | Ishii | |
| 2009/0133946 | A1 | 5/2009 | Pels | |
| 2013/0060455 | A1 * | 3/2013 | Kawasumi | 701/113 |
| 2014/0014064 | A1 * | 1/2014 | Kawasumi | 123/311 |

FOREIGN PATENT DOCUMENTS

| | | |
|---|---|---|
| JP | 2002-130095 | 5/2002 |
| JP | 2002-332938 | 11/2002 |
| JP | 2003-343404 | 12/2003 |
| JP | 2004-239111 | 8/2004 |
| JP | 2005-299481 | 10/2005 |
| JP | 2007-132335 | 5/2007 |
| JP | 3969641 | 9/2007 |
| WO | 2008068921 | 6/2008 |

OTHER PUBLICATIONS

IPRP for related PCT/JP2011/070939 issued on Mar. 19, 2013 and its English translation issued on Apr. 9, 2013.

From U.S. Appl. No. 13/664,306 (now published as 2013-0060455 A1), Notice of Allowance mailed on Feb. 15, 2013.

* cited by examiner

ENGINE CONTROL UNIT, ENGINE CONTROL SYSTEM AND ENGINE CONTROL METHOD

CROSS-REFERENCE TO RELATED APPLICATIONS

This application is the U.S. National Stage Application of International Patent Application No. PCT/JP2011/070939 filed on Sep. 14, 2011, which claims priority to Japanese Patent Application No. 2010-208166 filed on Sep. 16, 2010, the disclosures of which are hereby incorporated by reference in their entireties.

TECHNICAL FIELD OF THE INVENTION

The present invention relates to an engine control unit, an engine control system, and an engine control method of controlling driving of an engine.

BACKGROUND ART

When an engine starts, the crank shaft of the engine is driven to rotate by rotational force outputting means such as a starter. When the crank shaft rotates, friction in the engine and the compression pressure in, particularly, a cylinder in the compression stroke act as a resistance to the rotation.

If the resistive force to the rotation is too high, the engine may stop running immediately before the top dead center of the cylinder in the compression stroke and fail to start. In a warm environment, in particular, the compression pressure increases significantly, so that the start failure is likely to occur.

To avoid such a start failure, there is a technique of making the rotational force outputting means intermittently apply the torque in the forward direction or alternately reverse the direction of the applied torque when the engine stops running during starting of the engine (see JP03-3969A, for example).

According to the conventional technique, since the torque in the forward direction is intermittently applied, or the direction of the applied torque is alternately reversed, the pressure in the cylinder is released when the torque is cut off, the frictional force changes from static friction to dynamic friction and therefore decreases, and an inertial torque occurs, so that the engine can more easily start.

There is another technique of making the rotational force outputting means run the engine in the reverse direction at the beginning of starting of the engine and then run the engine in the forward direction (see JP07-71350A).

According to this technique, the pressure in the cylinder is released when the torque is cut off, the frictional force changes from static friction to dynamic friction and therefore decreases, and an inertial torque occurs, so that the engine can more easily start.

There is another technique of rotating the crank shaft in the reverse direction to a predetermined position immediately after the engine is stopped to provide for the next engine start (see JP396941B, JP2002-130095A and JP2002-332938A, for example).

According to this technique, the inertial force can be increased to improve the startability of the engine.

DISCLOSURE OF THE INVENTION

An engine control method according to one aspect of the invention is an engine control method of controlling driving of an engine, comprising:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of braking the motor in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

The engine control method may further comprises a tenth step of determining whether or not the engine speed of the engine is equal to or higher than a starting engine speed at which the engine starts, after the ninth step, wherein in a case where it is determined in the tenth step that the engine speed of the engine is lower than the starting engine speed, the method returns to the ninth step and drives the motor in the forward direction to run the engine in the forward direction again.

In the engine control method, in a case where it is determined in the second step that the crank angle lies in the first section, the method proceeds to the fifth step and provides a state where there is no load on the motor.

In the engine control method, in a case where it is determined in the fourth step that the crank angle does not lie in the first section, the method returns to the third step and drives the motor in the forward direction to run the engine in the forward direction.

In the engine control method, in a case where it is determined in the sixth step that the crank angle does not lie in the second section, the method continues to provide a state where there is no load on the motor.

In the engine control method, in a case where it is determined in the eighth step that there is no request for restart of the engine, the method continues to provide a state where there is no load on the motor.

The engine control method may further comprise an eleventh step of determining whether or not there is the request for restart of the engine in a case where it is determined in the first step that the engine speed of the engine is equal to or higher than the prescribed engine speed; and a twelfth step of driving the motor in the forward direction to run the engine in the forward direction in a case where it is determined in the eleventh step that there is the request for restart of the engine.

In the engine control method, in a case where it is determined in the eleventh step that there is no request for restart of the engine, the method returns to the first step and determines again whether or not the engine speed of the engine is lower than the preset, prescribed engine speed.

The engine control method may further comprise a thirteenth step of determining whether or not the engine speed of the engine is equal to or higher than a starting engine speed at which the engine starts, after the twelfth step, wherein in a case where it is determined in the thirteenth step that the engine speed of the engine is lower than the starting engine speed, the method returns to the twelfth step and drives the motor in the forward direction to run the engine in the forward direction again.

An engine control method according to another aspect of the invention is an engine control method of controlling driving of an engine, comprises a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of driving the motor in a reverse direction in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

In the engine control method, in a case where it is determined in the eighth step that there is no request for restart of the engine, the method returns to the seventh step and continues to drive the motor in the reverse direction.

The engine control method may further comprise a fourteenth step driving the motor in the reverse direction in a case where it is determined in the sixth step that the crank angle of the engine lies in the second section;

a fifteenth step of determining whether or not there is the request for restart of the engine; and a sixteenth step of determining whether or not a prescribed time has elapsed since the motor started being driven in the reverse direction in a case where it is determined in the fifteenth step that there is no request for restart of the engine, wherein in a case where it is determined in the sixteenth step that the prescribed time has elapsed since the motor was driven in the reverse direction, the method proceeds to the seventh step and brakes the motor.

In the engine control method, in a case where it is determined in the fifteenth step that there is the request for restart of the engine, the method proceeds to the ninth step and drives the motor in the forward direction to run the engine in the forward direction.

In the engine control method, in a case where it is determined in the sixteenth step that the prescribed time has not elapsed since the motor starts being driven in the reverse direction, the method returns to the fourteenth step and drives the motor in the reverse direction again.

In the engine control method, the engine speed of the engine is zero in a case where it is determined that the engine speed is lower than the prescribed engine speed.

In the engine control method, in the first step, it is determined that the engine speed of the engine is lower than the prescribed engine speed in a case where a stop time has elapsed since fuel injection to the engine is cut off, the stop time being a previously measured time required for the engine to stop running after fuel injection to the engine is cut off.

An engine control unit according to one aspect of the invention is an engine control unit that controls driving of an engine, performing:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of braking the motor in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

An engine control unit according to another aspect of the invention is an engine control unit that controls driving of an engine, performing:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of driving the motor in a reverse direction in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

The engine control unit may further comprises a power controlling circuit that is configured to control a operation of the motor that applies a torque to the engine;

a ROM that is configured to store a map used for controlling the motor; and a CPU that is configured to refer to the ROM and control the motor by controlling the power controlling circuit based on the engine speed and the crank angle of the engine detected by the sensor.

An engine control system according to another aspect of the invention is an engine control system that controls driving of an engine, comprises a motor that is configured to apply a torque to a crank shaft of the engine;

a sensor that is configured to detect the engine speed and the crank angle of the engine and output a detection signal responsive to the detection result; and an engine control unit that is configured to control driving of the engine based on the detection signal, wherein the engine control unit performing:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of braking the motor in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

An engine control system according to another aspect of the invention is an engine control system that controls driving of an engine, comprises a motor that is configured to apply a torque to a crank shaft of the engine;

a sensor that is configured to detect the engine speed and the crank angle of the engine and output a detection signal responsive to the detection result; and an engine control unit that is configured to control driving of the engine based on the detection signal, wherein the engine control unit performing:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center in a combustion stroke and a second angle, after the fifth step;

a seventh step of driving the motor in a reverse direction in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

The engine control system may further comprises a battery that is configured to supply a driving power to the motor and be recharged with a regenerated power from the motor.

In the engine control system, the motor is connected to the crank shaft of the engine in such a manner that the motor can apply a torque to the crank shaft and receive a torque from the crank shaft, the motor functioning as both an electric motor and an electric generator.

In the engine control system, the motor is connected to the crank shaft of the engine in such a manner that the motor can apply a torque to a crank shaft of the engine, the motor functioning as an electric motor.

An engine control unit according to an aspect of the present invention runs an engine into a first section shifted from a top dead center in a compression stroke by means of a motor when the engine is stopped.

As a result, air in a cylinder of the engine is compressed to have an increased repulsive force. If the motor enters into a load free state in this state, the engine runs in the reverse direction by the action of the repulsive force.

After the engine runs in the reverse direction into a second section in a combustion stroke, the motor is braked.

From this state, the engine can be run in the forward direction, thereby increasing the inertial force of the engine and starting the engine with higher reliability.

That is, the engine control unit according to the aspect of the present invention can start the engine with higher reliability.

BEST MODE FOR CARRYING OUT THE INVENTION

In the following, embodiments of the present invention will be described with reference to the drawings.

Embodiment 1

Figure 1:
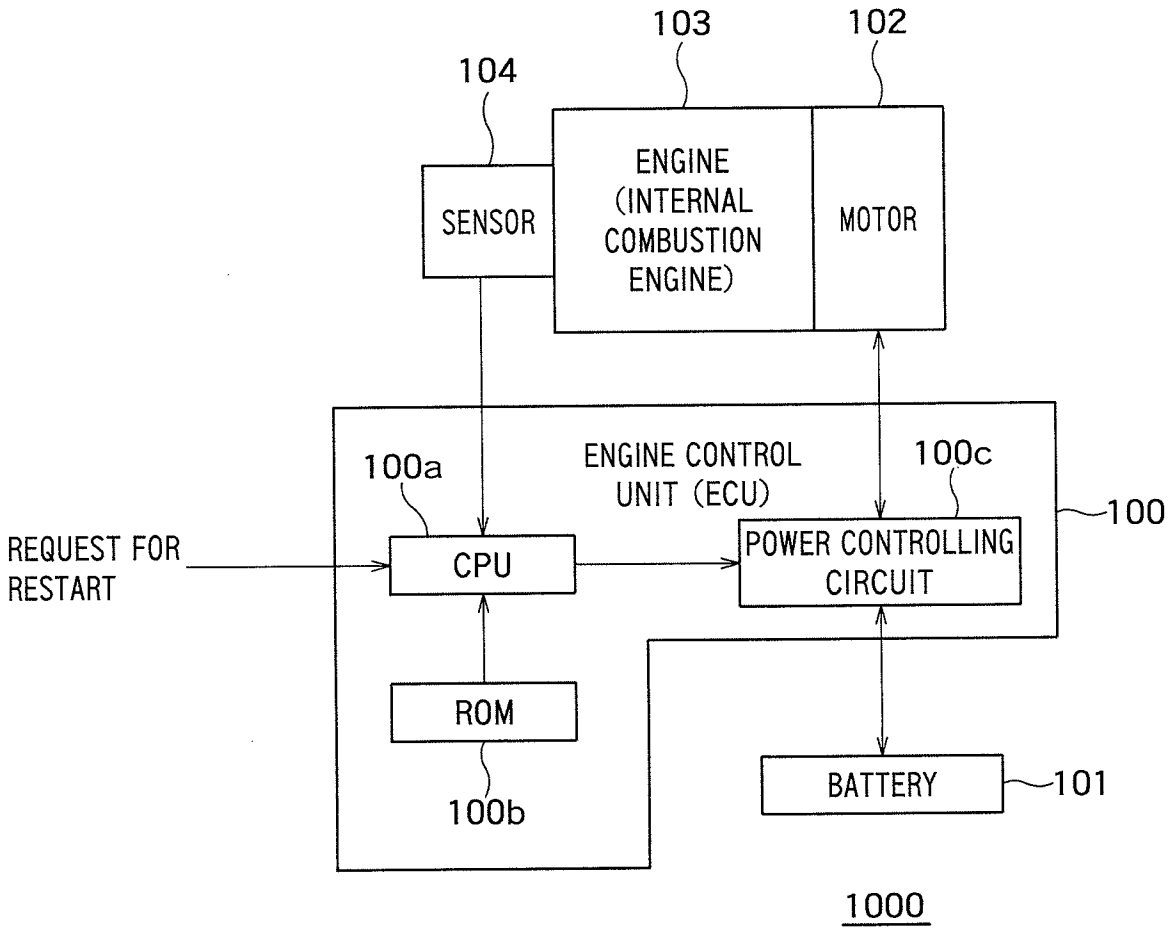
FIG. 1 is a diagram showing an example of a configuration of an engine control system 1000 according to an embodiment 1 of the present invention, which is an aspect of the present invention.

FIG. 1 is a diagram showing an example of a configuration of an engine control system 1000 according to an embodiment 1 of the present invention, which is an aspect of the present invention.

Figure 2:
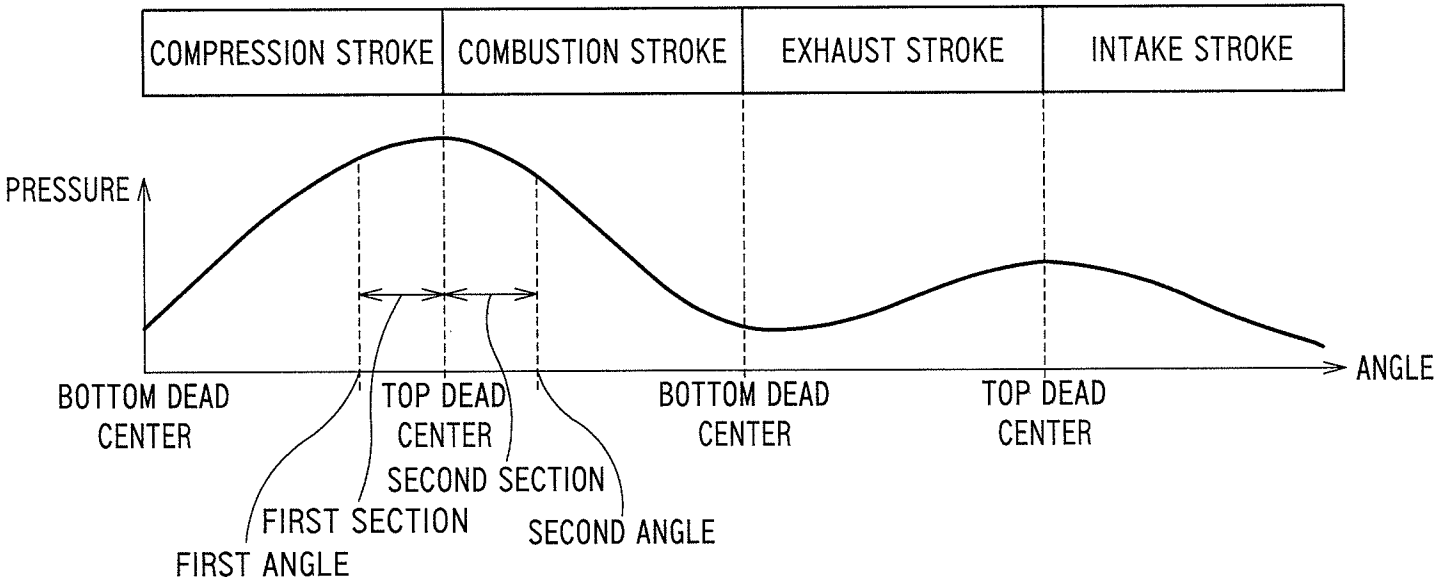
FIG. 2 is a diagram showing an example of a relationship between each stroke (crank angle) and the pressure of a cylinder of an engine 103 of the engine control system 1000 shown in FIG. 1.

FIG. 2 is a diagram showing an example of a relationship between each stroke (crank angle) and the pressure of a cylinder of an engine 103 of the engine control system 1000 shown in FIG. 1.

As shown in FIG. 1, the engine control system 1000 that controls driving of the engine has an engine control unit (ECU) 100, a battery 101, a motor 102, an engine (internal combustion engine) 103, and a sensor 104.

In this embodiment, the engine 103 is a four-stroke engine, for example. Therefore, as shown in FIG. 2, the status of the engine 103 transitions through an intake stroke, a compression stroke, a combustion stroke and an exhaust stroke. As shown in FIG. 2, the pressure in the cylinder of the engine 103 (in other words, the resistance to rotation of a crank) reaches the maximum at a top dead center.

The motor 102 is configured to apply a torque to a crank shaft of the engine 103. In this embodiment, the motor 102 is connected to the crank shaft of the engine 103 in such a manner that the motor 102 can apply a torque to the crank shaft and receive a torque from the crank shaft. That is, the motor 102 functions as both an electric motor and an electric generator.

The sensor 104 is configured to detect the engine speed and the crank angle of the engine 103 and output a detection signal responsive to the detection result.

The battery 101 is configured to supply a driving power to the motor 102 and be recharged with a regenerated power from the motor 103.

The engine control unit 100 is configured to control driving of the engine 103 by determining the status of the engine 102 based on the detection signal (more specifically, the engine speed and the crank angle of the engine 102 derived from the detection signal). In particular, in a case where there is a request for restart of the engine 103, the engine control unit 100 controls the operation of the engine 103 while driving the motor 102.

The engine control unit 100 has a central processing unit (CPU) 100*a*, a read only memory (ROM) 100*b*, and a power controlling circuit 100*c*.

The power controlling circuit 100*c* is configured to control the operation of the motor 102 that applies a torque to the engine 103.

The ROM 100*b* is configured to store a map used for controlling starting or other operations of the engine 103 (a map used for controlling the motor 102).

The CPU 100*a* is configured to refer to the ROM 100*b* and control the motor 102 by controlling the power controlling circuit 100*c* based on the number of revolutions and the crank angle of the engine 103 detected by the sensor 101.

Next, an example of an engine control method for the engine control unit 100 of the engine control system 1000 configured as described above to control driving (starting) of the engine 103 will be described.

Figure 3:
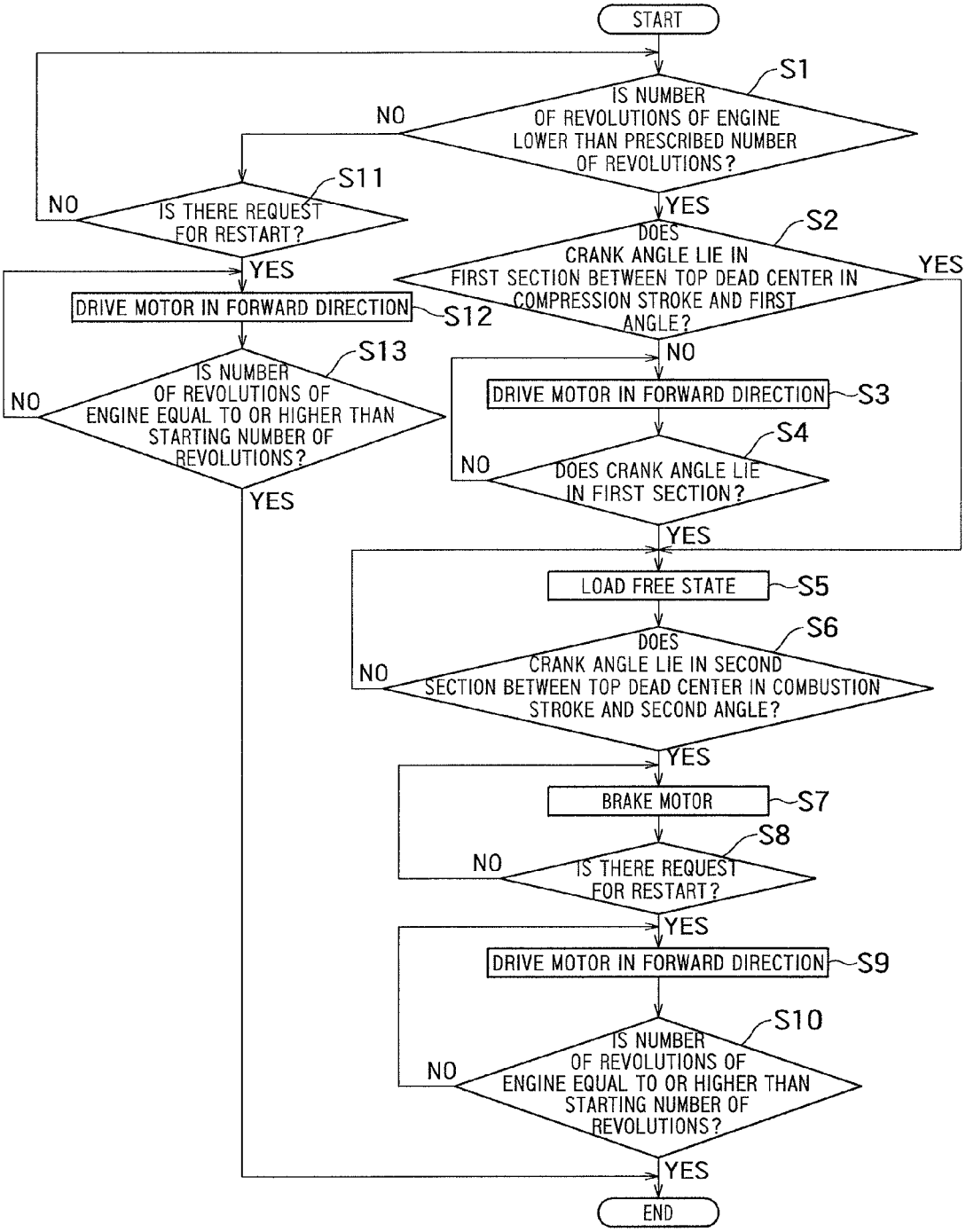
FIG. 3 is a flowchart showing an example of an engine control method according to the embodiment 1 performed by the engine control unit 100 shown in FIG. 1.

FIG. 3 is a flowchart showing an example of an engine control method according to the embodiment 1 performed by the engine control unit 100 shown in FIG. 1. That is, the engine control unit 100 performs the steps described below.

As shown in FIG. 3, the engine control unit 100 first determines whether or not the engine speed of the engine 103 is lower than a preset, prescribed engine speed (Step S1).

Note that a stop time required for the engine 103 to stop rotating (or for the engine speed of the engine 103 to decrease to zero) after fuel injection to the engine 103 is cut off is previously set by measurement, for example.

In Step S1, the engine control unit 100 determines that the engine speed of the engine 103 is lower than the prescribed engine speed if the stop time has elapsed since fuel injection to the engine 103 was cut off, for example.

In other words, if the engine control unit 100 determines that the engine speed is lower than the prescribed engine speed, it is determined that the engine speed of the engine 103 is zero, for example. In other words, if the engine speed is lower than the prescribed engine speed, it is determined that the engine 103 is stopped or about to stop.

In the case where the engine control unit 100 determines that the engine speed of the engine 103 is lower than the prescribed engine speed, the engine control unit 100 then determines whether or not the crank angle of the engine 103 lies in a first section between the top dead center in the compression stroke and a first angle (FIG. 2) (Step S2).

If the crank angle of the engine 103 does not lie in the first section, the engine control unit 100 then drives the motor 102 that applies a torque to the crank of the engine 103 in the forward direction, thereby running the engine 103 in the forward direction (Step S3).

Following Step S3, the engine control unit 100 determines whether or not the crank angle of the engine 103 lies in the first section (FIG. 2) (Step S4).

If the engine control unit 100 determines in Step S4 that the crank angle does not lie in the first section (FIG. 2), the engine control unit 100 returns to Step S3 and drives the motor 102 in the forward direction to run the engine 103 in the forward direction.

In this way, when the engine 103 is stopped, the motor 102 runs the engine 103 in the forward direction into the first section (FIG. 2) shifted from the top dead center in the compression stroke.

As a result, the air in the cylinder of the engine 103 is compressed to have a pressure close to the maximum pressure and a repulsive force is increased to a value close to the maximum value (FIG. 2).

On the other hand, if the engine control unit 100 determines in Step S4 that the crank angle of the engine 103 lies in the first section (FIG. 2), the engine control unit 100 provides a state where there is no load on the motor 102 (a load free state) (Step S5).

If the engine control unit 100 determines in Step S2 that the crank angle lies in the first section (FIG. 2), the engine control unit 100 proceeds to Step S5 and provides the state where there is no load on the motor 102.

If the motor enters into the load free state when the air in the cylinder of the engine is compressed and has an increased repulsive force as described above, the engine runs in the reverse direction by the action of the repulsive force.

Then, following Step S5, the engine control unit 100 determines whether or not the crank angle of the engine 103 lies in a second section between the top dead center in the combustion stroke and a second angle (FIG. 2) (Step S6).

If the engine control unit 100 determines in Step S6 that the crank angle does not lie in the second section (FIG. 2), the engine control unit 100 returns to Step S5 and continues to provide the state where there is no load on the motor 102.

On the other hand, if the engine control unit 100 determines in Step S6 that the crank angle of the engine 103 lies in the second section (FIG. 2), the engine control unit 100 brakes the motor 102 (Step S7). The braking is implemented by making the motor 102 operate as a power generation brake such as a regenerative brake, for example.

Then, following Step S7, the engine control unit 100 determines whether or not there is the request for restart of the engine 103 (Step S8).

If the engine control unit 100 determines in Step S8 that there is no request for restart of the engine 103, the engine control unit 100 returns to Step S7 and continues to provide the state where there is no load on the motor 102.

On the other hand, if the engine control unit 100 determines in Step S8 that there is the request for restart of the engine 103, the engine control unit 100 drives the motor 102 in the forward direction to run the engine 103 in the forward direction (Step S9).

Then, following Step S9, the engine control unit 100 determines whether or not the engine speed of the engine 103 is equal to or higher than the starting engine speed at which the engine 103 starts to run (Step S10).

If the engine control unit 100 determines in Step S10 that the engine speed of the engine 103 is lower than the starting engine speed, the engine control unit 100 returns to Step S9 and drives the motor 102 in the forward direction to run the engine 103 in the forward direction again.

Note that the starting engine speed is the engine speed at which the engine 103 starts. Therefore, the prescribed engine speed is lower than the starting engine speed.

On the other hand, if the engine control unit 100 determines in Step S10 that the engine speed of the engine 103 is equal to or higher than the starting engine speed, the engine control unit 100 ends the flow.

If the engine control unit 100 determines in Step S1 that the engine speed of the engine 103 is equal to or higher than the prescribed engine speed, the engine control unit 100 determines whether or not there is the request for restart of the engine 103 (Step S11).

If there is no request for restart of the engine 103, the engine control unit 100 returns to Step S1 and determines again whether or not the engine speed of the engine 103 is lower than the preset, prescribed engine speed.

On the other hand, if the engine control unit 100 determines in Step S11 that there is the request for restart of the engine 103, the engine control unit 100 drives the motor 102 in the forward direction to run the engine 103 in the forward direction (Step S12).

Then, following Step S12, the engine control unit 100 determines whether or not the engine speed of the engine 103 is equal to or higher than the starting engine speed at which the engine 103 starts (Step S13).

If the engine control unit 100 determines in Step S13 that the engine speed of the engine 103 is lower than the starting engine speed, the engine control unit 100 returns to Step S12 and drives the motor 102 in the forward direction to run the engine in the forward direction again.

On the other hand, if the engine control unit 100 determines in Step S13 that the engine speed of the engine 103 is equal to or higher than the starting engine speed, the engine control unit 100 ends the flow.

The flow described above ensures that the engine speed of the engine 103 is equal to or higher than the starting engine speed. Then, the engine 103 restarts.

As described above, when the engine 103 is stopped, the engine control unit runs the engine 103 in the forward direction into the first section shifted from the top dead center in the compression stroke by means of the motor 102.

As a result, the air in the cylinder of the engine is compressed to have an increased repulsive force. If the motor enters into the load free state in this state, the engine runs in the reverse direction by the action of the repulsive force.

Then, after the engine running in the reverse direction enters into the second section in the combustion stroke, the engine control unit 100 brakes the motor.

Then, from this state, the engine control unit 100 can run the engine in the forward direction, thereby increasing the inertial force of the engine and starting the engine with higher reliability.

As described above, the engine control method according to this embodiment can start the engine with higher reliability.

Embodiment 2

In the embodiment 1, an example of the engine control method for starting the engine has been described.

In Step S7 of the engine control method described above, the inertial force of the engine can be increased by driving the motor in the reverse direction, instead of braking the motor until the request for restart occurs.

In an embodiment 2, an example of the engine control method that drives the motor in the reverse direction until the request for restart occurs in Step S7 will be described. The engine control method according to the embodiment 2 is implemented by the engine control unit 100 of the engine control system 1000 according to the embodiment 1 shown in FIG. 1.

Figure 4:
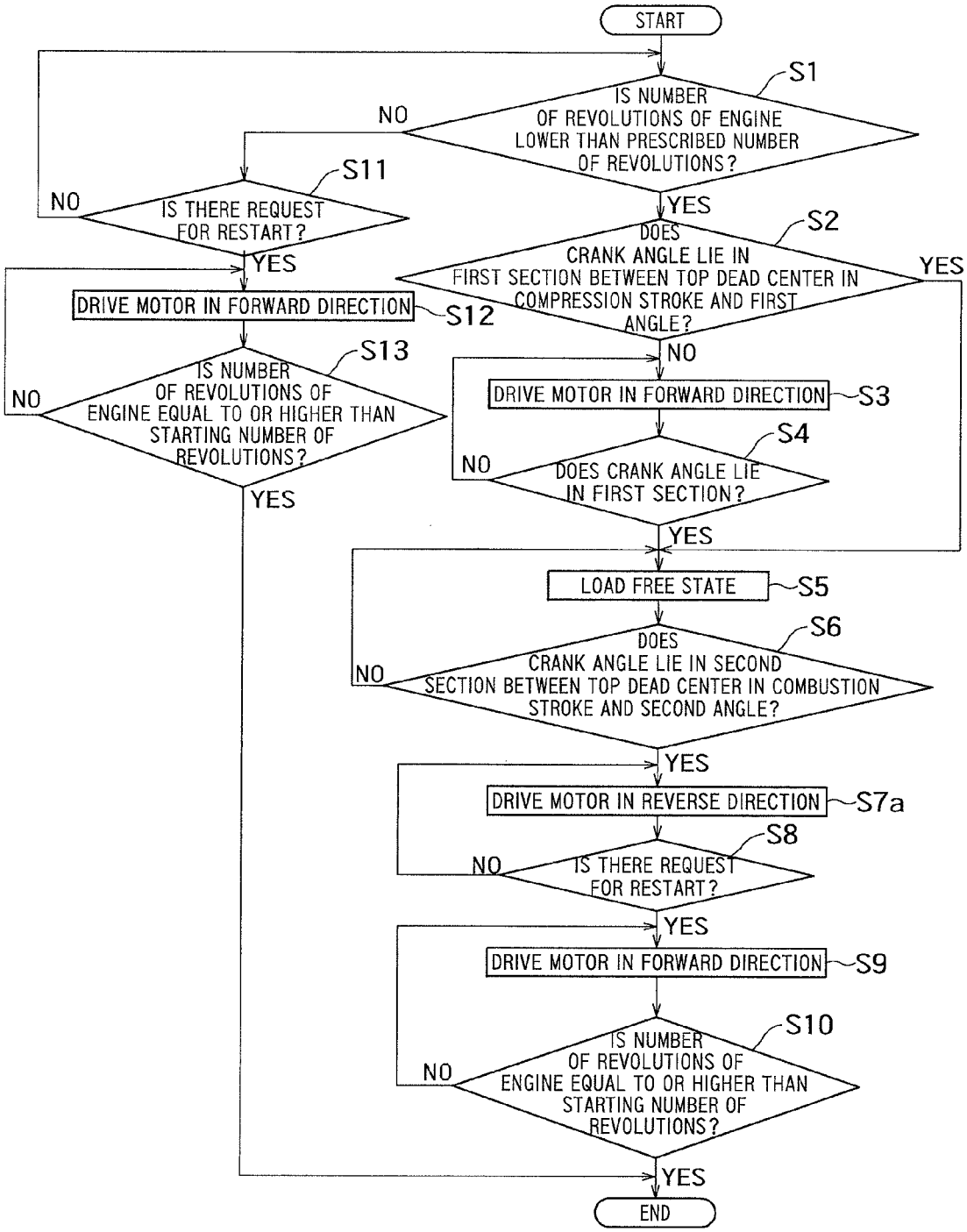
FIG. 4 is a flowchart showing the example of the engine control method according to the embodiment 2 implemented by the engine control unit 100 shown in FIG. 1.

FIG. 4 is a flowchart showing the example of the engine control method according to the embodiment 2 implemented by the engine control unit 100 shown in FIG. 1. In FIG. 4, the same reference numerals as those in the flowchart of FIG. 3 denote the same steps in FIG. 3. Specifically, Steps S1 to S6 and S8 to S13 in the flow shown in FIG. 4 are the same as those in the flow shown in FIG. 3.

As shown in FIG. 4, the engine control unit 100 performs Steps S1 to S6 as in the embodiment 1.

If the engine control unit 100 determines in Step S6 that the crank angle of the engine 103 lies in the second section, the engine control unit 100 drives the motor 102 in the reverse direction (Step S7*a*). In this way, the crank angle of the engine 103 is maintained in the second section.

Then, following Step S7*a*, the engine control unit 100 determines whether or not there is the request for restart of the engine 103 (Step S8).

If the engine control unit 100 determines in Step S8 that there is no request for restart of the engine 103, the engine control unit 100 returns to Step S7*a* and continues to drive the motor 102 in the reverse direction.

On the other hand, if the engine control unit 100 determines in Step S8 that there is the request for restart of the engine 103, the engine control unit 100 drives the motor 102 in the forward direction to run the engine 103 in the forward direction, as in the embodiment 1 (Step S9).

Then, as in the embodiment 1, the engine control unit 100 performs Steps S9, S10, and S11 to S13.

The flow described above ensures that the engine speed of the engine 103 is equal to or higher than the starting engine speed. Then, the engine 103 restarts in response to an operation of restarting fuel injection, for example.

As in the embodiment 1, when the engine 103 is stopped, the engine control unit 100 runs the engine 103 in the forward direction into the first section shifted from the top dead center in the compression stroke by means of the motor 102.

As a result, the air in the cylinder of the engine is compressed to have an increased repulsive force. If the motor enters into the load free state in this state, the engine runs in the reverse direction by the action of the repulsive force.

In the embodiment 2, then, after the engine running in the reverse direction enters into the second section in the combustion stroke, the engine control unit 100 drives the motor in the reverse direction.

Then, from this state, the engine control unit 100 can run the engine in the forward direction, thereby increasing the inertial force of the engine and starting the engine with higher reliability.

As described above, the engine control method according to this embodiment can start the engine with higher reliability.

Embodiment 3

In the embodiment 2, another example of the engine control method for starting the engine has been described.

In Step S7*a* of the engine control method described above, the inertial force of the engine can be increased by driving the motor in the reverse direction until a prescribed time elapses and then braking the motor until the request for restart occurs.

In an embodiment 3, another example of the engine control method that drives the motor in the reverse direction will be described. The engine control method according to the embodiment 3 is implemented by the engine control unit 100 of the engine control system 1000 according to the embodiment 1 shown in FIG. 1.

Figure 5:
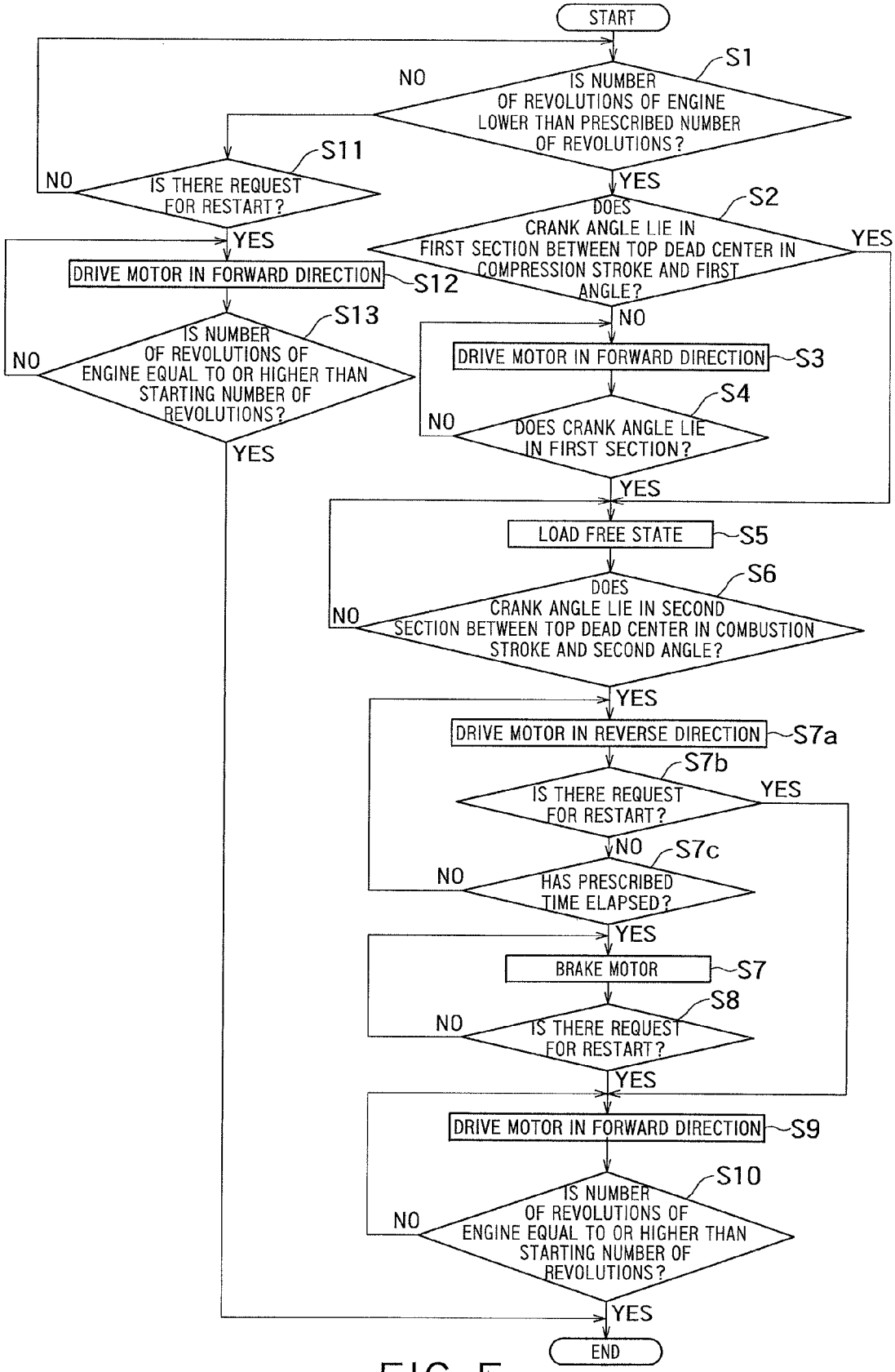
FIG. 5 is a flowchart showing the example of the engine control method according to the embodiment 3 implemented by the engine control unit 100 shown in FIG. 1.

FIG. 5 is a flowchart showing the example of the engine control method according to the embodiment 3 implemented by the engine control unit 100 shown in FIG. 1. In FIG. 5, the same reference numerals as those in the flowchart of FIG. 4 denote the same steps in FIG. 4. Specifically, Steps S1 to S7*a* and S8 to S13 in the flow shown in FIG. 5 are the same as those in the flow shown in FIG. 4.

As shown in FIG. 5, the engine control unit 100 performs Steps S1 to S6 as in the embodiments 1 and 2.

As in the embodiment 2, if the engine control unit 100 determines in Step S6 that the crank angle of the engine 103 lies in the second section (FIG. 2), the engine control unit 100 drives the motor 102 in the reverse direction (Step S7*a*). In this way, the crank angle of the engine 103 is maintained in the second section.

Then, following Step S7*a*, the engine control unit 100 determines whether or not there is the request for restart of the engine 103 (Step S7*b*).

If the engine control unit 100 determines in Step S7*b* that there is no request for restart of the engine 103, the engine control unit 100 determines whether or not a prescribed time has elapsed since the motor 102 started being driven in the reverse direction (Step S7*c*).

If the engine control unit 100 determines in Step S7*c* that the prescribed time has elapsed since the motor 102 was driven in the reverse direction, the engine control unit 100 proceeds to Step S7 and brakes the motor 102. In this way, the motor 102 can be prevented from continuing to be driven in the reverse direction despite there being no request for restart for a long time and wasting electric power.

On the other hand, if the engine control unit 100 determines in Step S7*c* that the prescribed time has not elapsed since the motor 102 starts being driven in the reverse direction, the engine control unit 100 returns to Step S7*a* and drives the motor 102 in the reverse direction again.

If the engine control unit 100 determines in Step S7*b* that there is the request for restart of the engine 103, the engine control unit 100 proceeds to Step S9 and drives the motor 102 in the forward direction to run the engine 103 in the forward direction.

Then, as in the embodiments 1 and 2, the engine control unit 100 performs Steps S9, S10, and S11 to S13.

The flow described above ensures that the engine speed of the engine 103 is equal to or higher than the starting engine speed. Then, the engine 103 restarts.

As in the embodiments 1 and 2, when the engine 103 is stopped, the engine control unit 100 runs the engine 103 in the forward direction into the first section shifted from the top dead center in the compression stroke by means of the motor 102.

As a result, the air in the cylinder of the engine is compressed to have an increased repulsive force. If the motor enters into the load free state in this state, the engine runs in the reverse direction by the action of the repulsive force.

In the embodiment 3, then, after the engine running in the reverse direction enters into the second section in the combustion stroke, the engine control unit 100 drives the motor in the reverse direction as in the embodiment 2.

Then, if no request for restart occurs for the prescribed time, the engine control unit 100 brakes the motor.

Then, from this state, the engine control unit 100 can run the engine in the forward direction, thereby increasing the inertial force of the engine and starting the engine with higher reliability.

As described above, the engine control method according to this embodiment can start the engine with higher reliability.

Note that although FIG. 1 shows the engine 103 and the motor 102 integrated with each other, the engine 103 and the motor 102 may be separated from each other.

Furthermore, in the embodiments described above, the motor 102 functions as both an electric motor and an electric generator.

However, the effects and advantages of the present invention can be provided even if the motor 102 is connected to the crank shaft of the engine 103 to apply a torque thereto and functions only as an electric motor. In this case, a separate motor that functions as an electric generator can be used.

The embodiments described above are given for the purpose of illustration, and the scope of the present invention is not limited to the embodiments.

The invention claimed is:

1. An engine control method of controlling driving of an engine, comprising:

a first step of determining whether or not an engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center and a second angle in a combustion stroke, after the fifth step;

a seventh step of braking the motor in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

2. The engine control method according to claim 1, further comprising:

a tenth step of determining whether or not the engine speed of the engine is equal to or higher than a starting engine speed at which the engine starts, after the ninth step, wherein in a case where it is determined in the tenth step that the engine speed of the engine is lower than the starting engine speed, the method returns to the ninth step and drives the motor in the forward direction to run the engine in the forward direction again.

3. The engine control method according to claim 1, wherein in a case where it is determined in the second step that the crank angle lies in the first section, the method proceeds to the fifth step and provides a state where there is no load on the motor.

4. The engine control method according to claim 1, wherein in a case where it is determined in the fourth step that the crank angle does not lie in the first section, the method returns to the third step and drives the motor in the forward direction to run the engine in the forward direction.

5. The engine control method according to claim 1, wherein in a case where it is determined in the sixth step that the crank angle does not lie in the second section, the method continues to provide a state where there is no load on the motor.

6. The engine control method according to claim 1, wherein in a case where it is determined in the eighth step that there is no request for restart of the engine, the method continues to provide a state where there is no load on the motor.

7. The engine control method according to claim 1, further comprising:

an eleventh step of determining whether or not there is the request for restart of the engine in a case where it is determined in the first step that the engine speed of the engine is equal to or higher than the prescribed engine speed; and a twelfth step of driving the motor in the forward direction to run the engine in the forward direction in a case where it is determined in the eleventh step that there is the request for restart of the engine.

8. The engine control method according to claim 7, wherein in a case where it is determined in the eleventh step that there is no request for restart of the engine, the method returns to the first step and determines again whether or not the engine speed of the engine is lower than the preset, prescribed engine speed.

9. The engine control method according to claim 7, further comprising:

a thirteenth step of determining whether or not the engine speed of the engine is equal to or higher than a starting engine speed at which the engine starts, after the twelfth step, wherein in a case where it is determined in the thirteenth step that the engine speed of the engine is lower than the starting engine speed, the method returns to the twelfth step and drives the motor in the forward direction to run the engine in the forward direction again.

10. An engine control method of controlling driving of an engine, comprising:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center and a second angle in a combustion stroke, after the fifth step;

a seventh step of driving the motor in a reverse direction in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

11. The engine control method according to claim 10, wherein in a case where it is determined in the eighth step that there is no request for restart of the engine, the method returns to the seventh step and continues to drive the motor in the reverse direction.

12. The engine control method according to claim 1, further comprising:

a fourteenth step driving the motor in the reverse direction in a case where it is determined in the sixth step that the crank angle of the engine lies in the second section;

a fifteenth step of determining whether or not there is the request for restart of the engine; and a sixteenth step of determining whether or not a prescribed time has elapsed since the motor started being driven in the reverse direction in a case where it is determined in the fifteenth step that there is no request for restart of the engine, wherein in a case where it is determined in the sixteenth step that the prescribed time has elapsed since the motor was driven in the reverse direction, the method proceeds to the seventh step and brakes the motor.

13. The engine control method according to claim 12, wherein in a case where it is determined in the fifteenth step that there is the request for restart of the engine, the method proceeds to the ninth step and drives the motor in the forward direction to run the engine in the forward direction.

14. The engine control method according to claim 12, wherein in a case where it is determined in the sixteenth step that the prescribed time has not elapsed since the motor starts being driven in the reverse direction, the method returns to the fourteenth step and drives the motor in the reverse direction again.

15. An engine control unit that controls driving of an engine, comprising:

a power controlling circuit that is configured to control a operation of the motor that applies a torque to the engine;

a ROM that is configured to store a map used for controlling the motor; and a CPU that is configured to refer to the ROM and control the motor by controlling the power controlling circuit based on the number of revolutions and the crank angle of the engine detected by the sensor, and the engine control unit performing:

a first step of determining whether or not a engine speed of the engine is lower than a preset, prescribed engine speed;

a second step of determining whether or not a crank angle of the engine lies in a first section between a top dead center in a compression stroke and a first angle in a case where the engine speed of the engine is lower than the prescribed engine speed;

a third step of running the engine in a forward direction by driving a motor that applies a torque to a crank of the engine in the forward direction in a case where the crank angle of the engine does not lie in the first section;

a fourth step of determining whether or not the crank angle of the engine lies in the first section, after the third step;

a fifth step of removing any load from the motor in a case where it is determined in the fourth step that the crank angle of the engine lies in the first section;

a sixth step of determining whether or not the crank angle of the engine lies in a second section between a top dead center and a second angle in a combustion stroke, after the fifth step;

a seventh step of braking the motor in a case where it is determined in the sixth step that the crank angle of the engine lies in the second section;

an eighth step of determining whether or not there is a request for restart of the engine, after the seventh step; and a ninth step of running the engine in the forward direction by driving the motor in the forward direction in a case where it is determined in the eighth step that there is the request for restart of the engine.

* * * * *